US008174191B2

(12) United States Patent
Hombach et al.

(10) Patent No.: US 8,174,191 B2
(45) Date of Patent: May 8, 2012

(54) DIELECTRIC BARRIER DISCHARGE LAMP CONFIGURED AS A COAXIAL DOUBLE TUBE HAVING A GETTER

(75) Inventors: Axel Hombach, Kürten (DE); Oliver Rosier, Wipperfürth (DE)

(73) Assignee: Osram AG, Munich (DE)

( * ) Notice: Subject to any disclaimer, the term of this patent is extended or adjusted under 35 U.S.C. 154(b) by 0 days.

(21) Appl. No.: 12/737,405

(22) PCT Filed: Jul. 15, 2008

(86) PCT No.: PCT/EP2008/059220

§ 371 (c)(1),
(2), (4) Date: Jan. 11, 2011

(87) PCT Pub. No.: WO2010/006642

PCT Pub. Date: Jan. 21, 2010

(65) Prior Publication Data

US 2011/0101858 A1 May 5, 2011

(51) Int. Cl.
*H01J 17/24* (2006.01)
*H01J 19/70* (2006.01)
*H01J 61/26* (2006.01)

(52) U.S. Cl. ..... 313/552; 313/549; 313/561; 313/562

(58) Field of Classification Search ..... 313/17–28, 313/545–566
See application file for complete search history.

(56) References Cited

U.S. PATENT DOCUMENTS 5,444,331 A 8/1995 Matsuno et al.
5,581,152 A * 12/1996 Matsuno et al. ..... 313/634
5,666,026 A * 9/1997 Matsuno et al. ..... 313/634

FOREIGN PATENT DOCUMENTS

EP 0 607 960 B2 7/1994
JP 10 283994 A 10/1998
JP 2002-313286 A 10/2002
JP 2006228563 A * 8/2006
JP 2006244898 A * 9/2006
JP 2009117148 A * 5/2009

* cited by examiner

*Primary Examiner* — Mariceli Santiago
(74) *Attorney, Agent, or Firm* — Holtz, Holtz, Goodman & Chick, P.C.

(57) ABSTRACT

A dielectric barrier discharge lamp (1) configured as a coaxial double tube comprises an inner tube (3), which is disposed coaxially inside an outer tube (2). The inner tube (3) comprises an inner electrode tube (8) provided for receiving the inner electrode (7) and a getter tube (10) provided for receiving getter material (9). The inner electrode tube (8) and getter tube (10) are separated from each other in a gastight manner by a partition (11).

12 Claims, 1 Drawing Sheet

A-B

DIELECTRIC BARRIER DISCHARGE LAMP CONFIGURED AS A COAXIAL DOUBLE TUBE HAVING A GETTER

This application is a U.S. National Phase Application under 35 USC 371 of International Application No. PCT/EP2008/059220 filed Jul. 15, 2008.

TECHNICAL FIELD

The invention is based on a dielectric barrier discharge lamp with a discharge vessel with a coaxial double-tube arrangement, i.e. an inner tube is arranged coaxially within an outer tube. In this case, the inner tube and the outer tube are connected to one another and form the gas-tight discharge vessel. The discharge space enclosed by the discharge vessel therefore extends between the inner tube and the outer tube and is filled with a discharge medium, which typically contains one or more noble gases, for example xenon.

This type of discharge lamp typically has a first electrode, which is arranged within the inner tube, and a second electrode, which is arranged on the outer side of the outer tube. Both electrodes are therefore located outside the discharge vessel. There is therefore a discharge which is dielectrically impeded on two sides.

In the case of dielectric barrier discharge with, for example, the noble gas xenon as the discharge medium, xenon excimers ($Xe_2$*) are produced, inter alia, which emit electromagnetic radiation with wavelengths in the region of around approximately 172 nm as they return from the excited state to the initial state. Impurities, for example oxygen or hydrogen, in the discharge medium reduce the efficiency of the useful radiation generation. Firstly, some of the electrical excitation power is used in the undesirable excitation of the atomic and/or molecular constituents of the impurities. Secondly, the impurities have the effect that some of the excimers return to the initial state without emitting any radiation.

This type of lamp is used in particular for UV radiation in processing, technology, for example for surface cleaning and activation, photolytics, ozone generation, drinking water purification, metallization and UV curing. In this context, the term emitter or UV emitter is also conventional.

PRIOR ART

Document EP 0 607 960 A1 has disclosed a dielectric barrier discharge lamp with a coaxial double-tube arrangement. In order to bind impurities, a getter material is arranged either in an extension, on one side, of the discharge space in the form of an annular gap (FIGS. 1-3), in a flat, circular protrusion of the discharge vessel (FIG. 4) or in a separate vessel (FIG. 5), which is connected to the discharge space. In each case, measures are provided for preventing the getter material from entering the discharge space unintentionally, for example by virtue of the getter space being connected to the discharge space via a constricted vessel section. However, one problem consists in that, owing to the spatial vicinity of the getter space with respect to the discharge space, parasitic discharges can form in the region of the getter space. The parasitic discharges impair the efficiency of the emitter.

DESCRIPTION OF THE INVENTION

The object of the present invention is to provide a dielectric barrier discharge lamp with a coaxial double-tube arrangement with an improved arrangement of a getter material.

This object is achieved by a dielectric barrier discharge lamp with a coaxial double-tube arrangement with a discharge vessel, which comprises an outer tube and an inner tube, wherein the inner tube is arranged coaxially within the outer tube, the inner tube and the outer tube are connected to one another in a gas-tight manner, as a result of which a discharge space filled with a discharge medium is formed between the inner tube and the outer tube, an outer electrode, which is arranged on the outer side of the outer tube, an inner electrode, which is arranged within the inner tube, a getter material, which is in contact with the discharge medium, characterized in that the inner tube is shorter than the outer tube, the inner tube and the outer tube are connected to one another in a gas-tight manner at one of their respective ends, the outer tube is sealed in a gas-tight manner at its other end, and the inner tube which protrudes into the outer tube comprises the following: a first tube section, the inner electrode tube, in which the inner electrode is arranged, a second tube section, the getter tube, in which the getter material is arranged, a dividing wall, which separates the two tube sections from one another in a gas-tight manner.

Particularly advantageous configurations are given in the dependent claims.

The basic concept of the invention consists in that the getter space is restricted to a region close to the axis, i.e. is not arranged in the extension of the discharge space in the form of an annular gap. For this purpose, according to the invention, a getter tube provided for accommodating the getter material adjoins the inner electrode tube provided for accommodating the inner electrode coaxially, but is separated from said inner electrode tube in a gas-tight manner by a dividing wall. As a result, the path from the getter material to the outer electrodes is relatively long. As a result of the long path between the getter material and the electrodes, parasitic discharges are avoided or at least markedly reduced. Owing to the dividing wall between the getter tube and the inner electrode tube, the getter space formed by the getter tube and consequently also the discharge space connected to the getter space via the getter tube opening is sealed from the outside in a gas-tight manner.

The getter tube can be formed by virtue of the fact that the inner tube is extended beyond the length of the inner electrode. In this case, the tube section provided for accommodating the getter material is separated from the rest of the inner tube in a gas-tight manner by means of a separately inserted and welded-in dividing wall. In other words, in this case the getter tube forming the getter space and the inner electrode tube accommodating the inner electrode are functionally different sections, which are separated by the dividing wall, of the same single-part inner tube.

Alternatively, the getter tube can be formed by a separate tube, which adjoins that end of the inner electrode tube which protrudes into the outer tube, i.e. in this case the inner tube comprises two separate tube parts: namely the inner electrode tube and the getter tube. The dividing wall which separates the two tube parts in a gas-tight manner is formed by a corresponding end, which is sealed in a gas-tight manner, of one of the two tube parts. That is to say that the dividing wall is formed, for example, by that end of the inner electrode tube (8) which is sealed in a gas-tight manner and to which the getter tube is attached and therefore connected in a gas-tight manner. However, conversely, it is also possible for the getter tube to first be sealed at one end and then with this sealed end to be attached and connected to the open end of the inner electrode tube.

In addition, the diameter of the inner electrode tube and the diameter of the getter tube can be the same or different. For the safe arrangement of the getter material, it may also be advantageous to taper the getter tube in the direction of the opening.

The length of the getter tube in the axial direction is adjusted in such a way that a sufficient quantity of getter material can be accommodated. Secondly, the getter tube should not be too long since, otherwise, the emitting section, which extends only onto the region with the inner electrode, is reduced excessively in relation to the total length of the emitter. In practice, lengths in the range of between approximately 0.5 cm and 5 cm have proven to be suitable, depending on the total length of the emitter, for the getter tube.

The getter material can be applied, for example, at least to part of the inner surface of the getter tube, for example by virtue of barium being vapor-deposited. However, the getter material can also be arranged in the getter tube in another way, for example squeezed into the getter tube in strip form or the like. In addition to barium, other suitable getter materials can also be considered, for example porous or pulverulent oxides, nitrides and carbides as well as titanium, tantalum, aluminum, zirconium and combinations thereof.

In order to promote the exchange of discharge medium between the discharge space and the axial getter space, this exchange being required for the getter material to take effect, the diameter of the opening of the getter tube is preferably equal to or greater than the distance between the outer side of the inner tube and the inner side of the outer tube, which distance defines the flashover path of the discharge.

In addition, in order to suppress oscillations and to stabilize the inner tube, it may be advantageous, in particular in the case of long tubes, to support the free end of the inner tube, for example in the region of the getter tube, between the inner tube and the outer tube with a suitable means, for example an appropriately sized holding disk. In order not to impair the exchange of discharge medium and consequently the getter effect, the holding disk does need to have corresponding openings, for example bores, slits or the like, however.

BRIEF DESCRIPTION OF THE DRAWINGS

The invention will be explained in more detail below with reference to an exemplary embodiment. In the figures.

PREFERRED EMBODIMENT OF THE INVENTION

Identical or functionally identical elements have been provided with the same reference symbols in the figures.

Figure 1A:
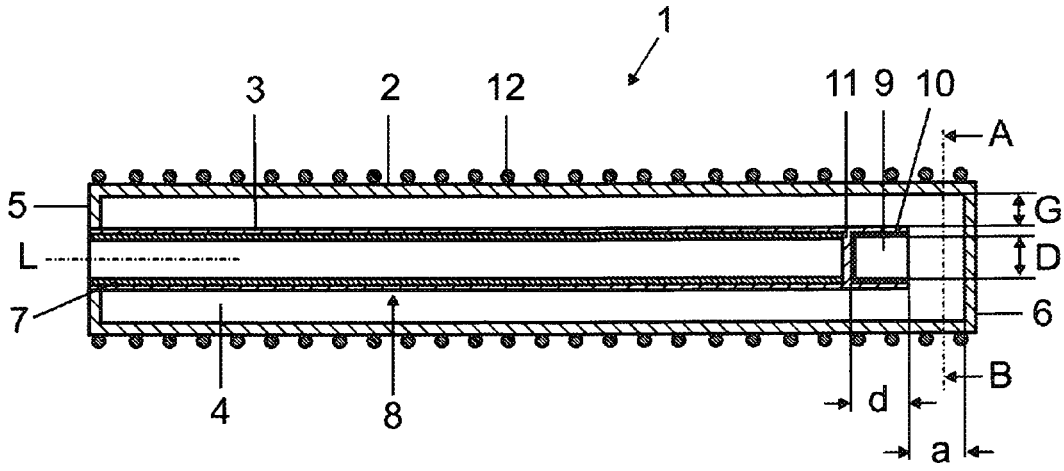
FIG. 1*a* shows a longitudinal sectional illustration of a dielectric barrier discharge lamp according to the invention.
Figure 1B:
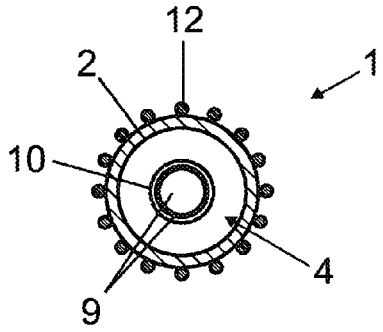
FIG. 1*b* shows a cross-sectional illustration of the lamp shown in FIG. 1*a* along the section line AB.

FIGS. 1*a* and 1*b* show a very schematized illustration of a longitudinal section and, respectively, a cross section along the section line AB of an exemplary embodiment of the dielectric barrier discharge lamp 1 according to the invention. The elongate discharge vessel of the lamp 1 comprises an outer tube 2 and an inner tube 3 with a coaxial double-tube arrangement, as a result of which the longitudinal axis L of the discharge vessel is defined. The typical length of the outer tube 2 is between approximately 10 and 250 cm, depending on the application. The outer tube 2 has a typical outer diameter of 44 mm and a wall thickness of 2 mm. The inner tube 3 has a typical outer diameter of 20 mm and a wall thickness of 1 mm. Both tubes 2, 3 consist of quartz glass which is transmissive to UV radiation. In addition, the discharge vessel is sealed at both of its end sides in such a way that an elongate discharge space 4 in the form of an annular gap is formed. For this purpose, the discharge vessel has at one end a suitably shaped, annular vessel section 5, which connects the corresponding ends of the inner and outer tubes there. At its other end, the discharge vessel is sealed with a circular vessel section 6, which adjoins the corresponding end of the outer tube 2 there. In addition, an exhaust tube (not illustrated) is attached there, which is used first to evacuate the discharge space 4 and then to fill it with 15 kPa of xenon as discharge medium. Then, the exhaust tube is fuse-sealed. The inner tube 3 ends at a distance a of approximately 1 cm in front of the circular vessel section 6 at the end of the outer tube 2. The inner tube 3 comprises a first functional section, which is used for accommodating an inner electrode 7, namely the inner electrode tube 8. A second functional section, which is used for accommodating a getter material 9, namely the getter tube 10, adjoins this inner electrode tube 8. The inner electrode tube 8 and the getter tube 10 are separated by a dividing wall 11. This dividing wall 11 in addition seals off the discharge vessel in this region of the inner tube 3 in a gas-tight manner. On the other side, the getter tube 10 is open, with the result that the discharge medium can pass from the discharge space 4 into the getter tube 10 and come into contact with the getter material 9. The getter material 9 consists of barium and is vapor-deposited onto the inner side of the getter tube 10, including the facing side of the dividing wall 11. The length d of the getter tube 10 is approximately 1 cm. The inner diameter D is approximately 18 mm and is therefore greater than the flashover path G, which is defined by the distance between the outer side of the inner tube 3 and the inner side of the outer tube 2 and is approximately 10 mm. A wire mesh 12, which forms the outer electrode of the lamp 1, is drawn onto the outer side of the wall of the outer tube 2. The inner electrode 7 is in the form of a slotted metal tube and comprises a 0.1 mm thick metal sheet, preferably a stainless steel sheet.

In particular in the case of relatively long tubes, it may be envisaged in order to avoid oscillations of the inner tube to support the inner tube, preferably in the region of the getter tube, with the aid of an appropriately sized holding disk (not illustrated). For this purpose, the holding disk has a central bore in order that it can be fitted onto the inner tube. The outer diameter of the holding disk is also dimensioned such that the holding disk fits precisely between the inner and outer tubes. In order not to impair the exchange of discharge medium between the discharge space and the getter space and consequently the getter effect, the holding disk is provided with suitable openings, for example bores, slits etc.

For installation in a process chamber, the emitter can be provided, at least at one end, preferably at the end with the getter chamber, or else at both ends, in each case with a base (not illustrated).

The invention claimed is:

1. A dielectric barrier discharge lamp (1) with a coaxial double-tube arrangement with a discharge vessel, which comprises an outer tube (2) and an inner tube (3), wherein the inner tube (3) is arranged coaxially within the outer tube (2), the inner tube (3) and the outer tube (2) are connected to one another in a gas-tight manner, as a result of which a discharge space (4) filled with a discharge medium is formed between the inner and outer tubes, an outer electrode (12), which is arranged on the outside of the outer tube (2), an inner electrode (7), which is arranged within the inner tube (2), a getter material (9), which is in contact with the discharge medium, characterized in that the inner tube (3) is shorter than the outer tube (2), the inner tube (3) and the outer tube are connected to one another in a gas-tight manner at one of their respective ends, the outer tube (2) is sealed in a gas-tight manner at its other end, the inner tube (3), which protrudes into the outer tube (2), comprises the following:

a first tube section, the inner electrode tube (8), in which the inner electrode (7) is arranged, a second tube section, the getter tube (10), in which the getter material (9) is arranged, a dividing wall (11), which separates the two tube sections from one another in a gas-tight manner.

2. The lamp as claimed in claim 1, wherein the inner tube (3) with the two tube sections, the inner electrode tube (8) and the getter tube (10), is formed as one part.

3. The lamp as claimed in claim 1, wherein the getter tube (10) is formed by a separate tube which coaxially adjoins that end of the inner electrode tube (8) which protrudes into the outer tube (2), and wherein the dividing wall (11) is formed by the corresponding end, which is sealed in a gas-tight manner, of the getter tube (10) or the inner electrode tube (8).

4. The lamp as claimed in claim 1, wherein a diameter of the opening (D) of the getter tube (10) is equal to or greater than a distance between the outer side of the inner tube (3) and the inner side of the outer tube (2), which distance defines a flashover path (G) of the discharge.

5. The lamp as claimed in claim 1, wherein at least part of the inner surface of the getter tube (10) is provided with getter material.

6. The lamp as claimed in claim 1, wherein the diameters of the inner electrode tube (8) and the getter tube (10) are different.

7. The lamp as claimed in claim 1, wherein the length of the getter tube (10) in the direction of the longitudinal axis of the discharge vessel is in the range between 0.5 cm and 5 cm.

8. The lamp as claimed in claim 1, wherein the inner tube is supported with the aid of a holding means.

9. The lamp as claimed in claim 8, wherein the holding means is arranged in the region of the getter tube.

10. The lamp as claimed in either of claims 8 and 9, wherein the holding means is an annular holding disk, which extends between the outer side of the inner tube and the inner side of the outer tube.

11. The lamp as claimed in claim 10, wherein the holding disk has, in addition to a central bore, at least one further opening.

12. The lamp as claimed in claim 1, wherein the getter material comprises the following elements individually or in combination: porous or pulverulent oxides, nitrides and carbides as well as barium, titanium, tantalum, aluminum, and zirconium.

* * * * *